US005906475A

United States Patent [19]

Melane et al.

[11] Patent Number: 5,906,475

[45] Date of Patent: May 25, 1999

[54] HOUSING FOR A FAN

[75] Inventors: Marcus L. Melane, Irving; Curtis L. Hargroves, Double Oak; David S. Tunnell, Garland; Andrew G. Low, McKinney, all of Tex.

[73] Assignee: Alcatel USA Sourcing, L.P., Plano, Tex.

[21] Appl. No.: 08/969,068

[22] Filed: Nov. 12, 1997

[51] Int. Cl.[6] ..... F01D 25/24; B25G 3/18; F16D 1/00

[52] U.S. Cl. ..... 415/214.1; 415/213.1; 403/326

[58] Field of Search ..... 415/126, 213.1, 415/214.1; 403/315, 319, 326, 329

[56] References Cited

U.S. PATENT DOCUMENTS

| | | | |
|---|---|---|---|
| 1,909,353 | 5/1933 | Hughes et al. | 403/326 |
| 3,961,855 | 6/1976 | Basile | 403/329 |
| 4,345,874 | 8/1982 | Ozeki et al. | 415/214.1 |
| 4,353,680 | 10/1982 | Hiraoka et al. | 415/214.1 X |
| 4,568,243 | 2/1986 | Schubert et al. | 415/213.1 |
| 4,834,615 | 5/1989 | Mauch et al. | 415/213.1 |
| 5,186,605 | 2/1993 | Tracy | 415/213.1 X |
| 5,208,730 | 5/1993 | Tracy | 415/213.1 X |
| 5,335,722 | 8/1994 | Wu . | |
| 5,430,611 | 7/1995 | Patel et al. | 361/705 |
| 5,458,426 | 10/1995 | Ito | 403/326 X |
| 5,495,392 | 2/1996 | Shen . | |
| 5,526,875 | 6/1996 | Lin | 165/80.3 |
| 5,566,749 | 10/1996 | Jordan et al. | 165/80.3 |
| 5,594,623 | 1/1997 | Schwegler | 361/697 |
| 5,664,624 | 9/1997 | Tsai et al. | 165/80.3 |
| 5,713,790 | 2/1998 | Lin | 415/213.1 X |

FOREIGN PATENT DOCUMENTS

| | | | |
|---|---|---|---|
| 53-32949 | 3/1978 | Japan | 415/214.1 |
| 54-161103 | 12/1979 | Japan | 415/213.1 |
| 93/04289 | 3/1993 | WIPO | 415/213.1 |

*Primary Examiner*—John E. Ryznic
*Attorney, Agent, or Firm*—Baker & Botts, L.L.P.

[57] ABSTRACT

A housing (10) for a cooling fan (56) includes a first side wall (12) and a second side wall (14) separated by a front wall (16). A first wall portion (22) extends from the first side wall (22) toward the second side wall (14) and opposite from the front wall (16). A second wall portion (26) extends from the second side wall (14) toward the first side wall (12) and opposite from the front wall (16). A first flexible member (30) on the first wall portion (22) extends along the first side wall (12) and is arched toward the front wall (16). A second flexible member (32) on the second wall portion (26) extends along the second side wall (14) and is arched toward the front wall (16). A cooling fan (56) is inserted into the housing (10), compressing the first flexible member (30) and the second flexible member (32) that force the cooling fan (56) against the front wall (16). The front wall (16) may include tabs (42, 46, 48, 50) to enhance the ability to secure the cooling fan (56) within the housing (10).

7 Claims, 1 Drawing Sheet

HOUSING FOR A FAN

TECHNICAL FIELD OF THE INVENTION

The present invention relates in general to equipment cooling and more particularly to a housing for a cooling fan.

BACKGROUND OF THE INVENTION

In order to install or replace a cooling fan as part of an equipment cooling environment, existing designs require the use of screws or other types of fasteners. The removal of screws or other types of fasteners present a hazardous condition for the equipment due to the possibility of a screw or other type of fastener being dropped into the equipment. It is also very time consuming to remove and re-insert a screw or other type of fastener and may be difficult due to the location of removal and reinsertion. Therefore, it is desirable to readily install and replace a cooling fan without the need for screws and other types of fasteners.

SUMMARY OF THE INVENTION

From the foregoing, it may be appreciated that a need has arisen for a housing to secure a cooling fan in an equipment cooling environment without using screws or other similar types of fasteners. In accordance with the present invention, a housing for a fan is provided that substantially eliminates or reduces disadvantages and problems associated with existing cooling fan designs.

According to an embodiment of the present invention, there is provided a housing for a fan that includes a first side wall and a second side wall each having a first end and a second end, wherein the second end of the first and second side wall are coupled to a front wall. A first wall portion extends from the first end of the first side wall toward the second side wall. A second wall portion extends from the first end of the second side wall toward the first side wall. The front wall has at least one tab extending from a first orthogonal edge of the front wall toward the first and second wall portions. A first flexible member is on the first wall portion extending along the first side wall and arched toward the front wall. A second flexible member is on the second wall portion extending along the second side wall and arched toward the front wall. A fan can be inserted through a slight force depressing the first and second flexible members such that the first and second flexible members force the fan against the front wall in order to secure the fan within the housing.

The present invention provides various technical advantages over existing cooling fan designs. For example, one technical advantage is to secure a fan within a housing without the use of screws or other types of fasteners. Another technical advantage is provide a housing that allows for simple installation and removal of a cooling fan without the need for tools. Other technical advantages may be readily apparent to those skilled in the art from the following figures, description, and claims.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

Figure 1:
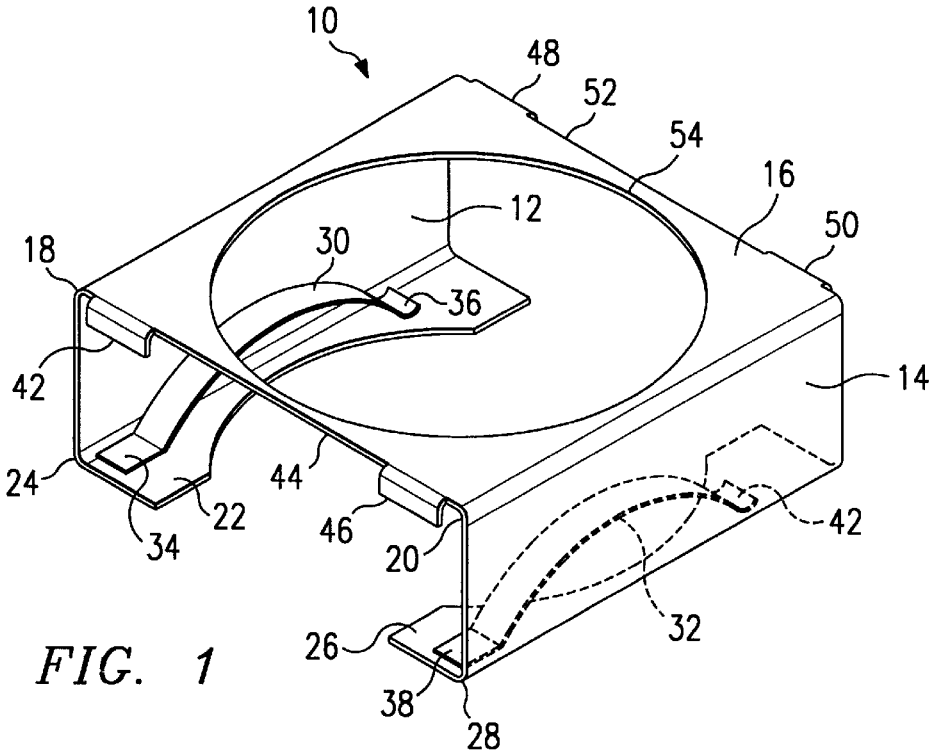
FIG. 1 illustrates a schematic diagram of a housing for a cooling fan.

FIG. 1 is a schematic diagram of a housing 10. Housing 10 includes a first side wall 12 and a second side wall 14. A front wall 16 extends between first side wall 12 and second side wall 14. Front wall 16 may be contiguous with a first end 18 of first side wall 12 and a first end 20 of second side wall 14. Alternatively, front wall 16 may be separately attached to first end 18 of first side wall 12 and second end 20 of second side wall 14. Housing 10 also includes a first wall portion 22 extending from a second end 24 of first side wall 12. First wall portion 22 may be contiguous with or separately attached to second end 24 of first side wall 12. A second wall portion 26 extends from a second end 28 of second side wall 14. Similarly, second wall portion 26 may be contiguous with or separately attached to second end 28 of second side wall 14.

First wall portion 22 has a first flexible member 30 coupled thereto. First flexible member 30 extends along first side wall 12 and is arched toward front wall 16. Second wall portion 26 has a second flexible member 32 coupled thereto. Second flexible member 32 extends along second side wall 14 and is arched toward front wall 16. First flexible member 30 has a first end 34 secured to first wall portion 22 and a second end 36 unsecured to allow for compression and decompression movement of flexible member 30. Similarly, second flexible member 32 has a first end 38 secured to second wall portion 26 and a second end 40 unsecured to allow for compression and decompression movement of second flexible member 32.

Front wall 16 may include a first tab 42 that may be contiguous with or separately attached to a first orthogonal end 44 of front wall 16. First tab 42 extends toward first wall portion 22. Similarly, front wall 16 may include a second tab 46 contiguous with or separately attached to first orthogonal end 44 that extends toward second wall portion 26. A third tab 48 and a fourth tab 50 may be similarly positioned on a second orthogonal end 52 of front wall 16. Though shown and describe in specific positions, tabs may be placed anywhere on front wall 16. Front wall 16 may include an aperture 54 to allow for air to flow through housing 10. Preferably, first wall portion 22 and second wall portion 26 do not extend into a plane formed by aperture 54 in order to provide a clear passage for air to flow through housing 10.

Figure 2:
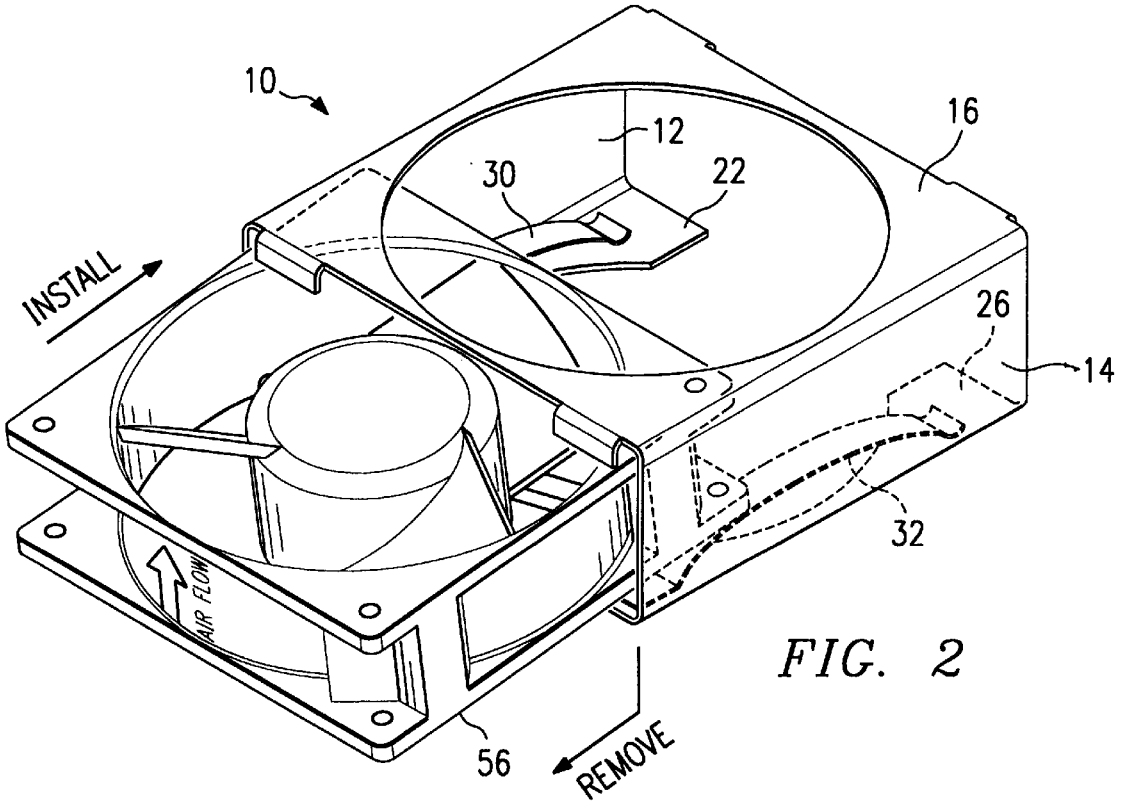
FIG. 2 illustrates a schematic diagram of the housing with the cooling fan.

FIG. 2 is a schematic diagram of housing 10 holding a cooling fan 56. Cooling fan 56 is inserted into housing 10 underneath tabs, if present, on front wall 16 and against first flexible member 30 and second flexible member 32. Cooling fan 56 slides into housing 10, compressing first flexible member 30 and second flexible member 32. Once cooling fan 56 is positioned under front wall 16, first flexible member 30 and second flexible member 32 force cooling fan 56 against front wall 16 to secure cooling fan 56 within housing 10. First flexible member 30 and second flexible member 32 may be made of steel for its spring elastic properties. First tab 42, second tab 46, third tab 48, and fourth tab 50 may be a part of front wall 16 to provide further ability to secure cooling fan within housing 10.

For removal, cooling fan 56 is forced downward against first flexible member 30 and second flexible member 32. This downward force further compresses first flexible member 30 and second flexible member 32 to allow cooling fan 56 to be clear of any tabs on front wall 16. Once cleared, cooling fan 56 is pulled away from and out of housing 10.

Thus, it is apparent that there has been provided, in accordance with the present invention, a housing for a fan that satisfies the advantages set forth above. Although the present invention has been described in detail, it should be understood that various changes, substitutions, and alterations may be readily ascertainable by those skilled in the art and may be made without departing from the spirit and scope of the present invention as defined by the following claims.

What is claimed is:

1. A housing for a fan, comprising:

a first side wall;

a second side wall;

a first wall portion extending from a first end of the first side wall towards a first end of the second side wall;

a second wall portion extending from the first end of the second side wall towards the first end of the first side wall;

a front wall extending from a second end of the first wall to a second end of the second wall, the front wall having a first tab extending toward the first wall portion from a first orthogonal end of the front wall;

a first steel member on the first wall portion extending along the first side wall, the first steel member being arched toward the front wall;

a second steel member on the second wall portion extending along the second side wall, the second steel member being arched toward the front wall.

2. The housing of claim 1, wherein the front wall has a second tab extending toward the second wall portion from the first orthogonal end of the front wall.

3. The housing of claim 2, wherein the front wall has a third tab extending toward the first wall portion from a second orthogonal end of the front wall.

4. The housing of claim 3, wherein the front wall has a fourth tab extending toward the second wall portion from the second orthogonal end of the front wall.

5. The housing of claim 1, wherein the front wall has an aperture extending therethrough.

6. The housing of claim 5, wherein the first and second wall portions do not extend into a plane extending through the aperture.

7. The housing of claim 1, further comprising:

a fan secured between the front wall and the first and second wall portions, the first and second steel members forcing the fan against the front wall in order to secure the fan within the housing.

* * * * *